US005993236A

United States Patent [19]

Vanderhoof et al.

[11] Patent Number: 5,993,236

[45] Date of Patent: Nov. 30, 1999

[54] TANGLE-FREE MODULAR PLUG CONNECTOR

[75] Inventors: Russell A. Vanderhoof, Minooka; Royal O. Jenner, Tinley Park, both of Ill.

[73] Assignee: Panduit Corp., Tinley Park, Ill.

[21] Appl. No.: 08/982,805

[22] Filed: Dec. 18, 1997

Related U.S. Application Data

[62] Division of application No. 08/536,810, Sep. 29, 1995, Pat. No. 5,727,962.

[51] Int. Cl.[6] ..... H01R 4/50

[52] U.S. Cl. ..... 439/344

[58] Field of Search ..... 439/344, 345, 439/350, 353, 354, 357, 358, 404, 676

[56] References Cited

U.S. PATENT DOCUMENTS

| | | | |
|---|---|---|---|
| 3,860,316 | 1/1975 | Hardesty | 339/91 R |
| 4,054,350 | 10/1977 | Hardesty | 339/99 R |
| 4,103,985 | 8/1978 | Krolak et al. | 339/126 R |
| 4,268,109 | 5/1981 | Hardesty | 339/205 |
| 4,379,609 | 4/1983 | Hardesty | 339/91 R |
| 4,615,575 | 10/1986 | Kossor | 339/82 |
| 4,986,766 | 1/1991 | Leonard et al. | 439/352 |
| 5,118,310 | 6/1992 | Stroede et al. | 439/676 |
| 5,194,014 | 3/1993 | McClune et al. | 439/404 |
| 5,429,522 | 7/1995 | Noschese et al. | 439/133 |
| 5,462,457 | 10/1995 | Schroepfer et al. | 439/736 |
| 5,613,869 | 3/1997 | Erlich et al. | 439/344 |
| 5,638,474 | 6/1997 | Lampert et al. | 385/78 |

FOREIGN PATENT DOCUMENTS

| | | |
|---|---|---|
| 0 028 120 A1 | 5/1981 | European Pat. Off. . |
| 3318966 A1 | 5/1982 | Germany . |
| 4238923 A1 | 5/1994 | Germany . |
| WO 96/26556 | 8/1996 | WIPO . |

*Primary Examiner*—Khiem Nguyen
*Attorney, Agent, or Firm*—Mark D. Hilliard; Robert A. McCann; Michael J. Turgeon

[57] ABSTRACT

The modular plug is provided with a latch arm that includes a free end that extends downwardly toward a top wall of the connector to terminate in close proximity to the surface of the connector or extends into a depression in the surface of the connector to prevent snagging or tangling of the latch arm with other connectors or surfaces.

7 Claims, 7 Drawing Sheets

TANGLE-FREE MODULAR PLUG CONNECTOR

This is a divisional of application Ser. No. 08/536,810, filed Sep. 29, 1995 now U.S. Pat. No. 5,727,962.

TECHNICAL FIELD

The present invention relates generally to modular communication connectors for electrically terminating and connecting conductors of communication cables, and relates specifically to modular plug connectors that mate with the socket of modular jack connectors.

BACKGROUND ART

Many different modular plugs of generally similar outward configuration, necessitated by the requirement of mating with a standard modular jack, are in wide use or have been proposed. For example note U.S. Pat. No. 4,054,350 to Hardesty.

Modular plugs typically are provided in multi-part bags and are terminated to cables to form cable harnesses that are used in confined spaces, such as patch panels or within trunking, such that it is desirable that the plugs not become entangled or snagged with other plugs, with other cable harnesses or some other surface. Prior art plugs include a latching arm that projects away from the body of each plug. See U.S. Pat. No. 5,100,339 to Sato et al. which proposes the use of a thin key member formed on the plug to mate with a slit in the end of the latch arm. This proposed solution appears to be difficult to manufacture with the thin key member being easily damaged. Also note FIG. 11 of Sato '339, which discloses a prior art connector that utilizes upwardly projecting blocking walls positioned on either side of and closely adjacent to the latch arm to prevent the latch arm from tangling with other surfaces. These blocking walls interfere with the release of the latch to remove the plug from a jack.

Thus there is a need in the art for an improved plug connector that prevents the latching arm of the plug from tangling with other objects without interfering with the manipulation of the latch to release the plug from a jack.

SUMMARY OF THE INVENTION

It is the object of the present invention to provide a connector that prevents the entanglement of the latching arm of the connector with other connectors or surfaces.

In general, a tangle free connector having a latch arm projecting outwardly from the connector, includes an inwardly protecting free end portion formed on the latch arm, the free end portion projecting inwardly toward a surface of the connector to a point in sufficient proximity with the surface such that the latch arm is less likely to tangle or snag with other objects. A depression can be formed in the connector surface disposed to receive a tip of the free end such that the tip extends below the surface of the connector.

DESCRIPTION OF THE PREFERRED EMBODIMENTS

Figure 1:
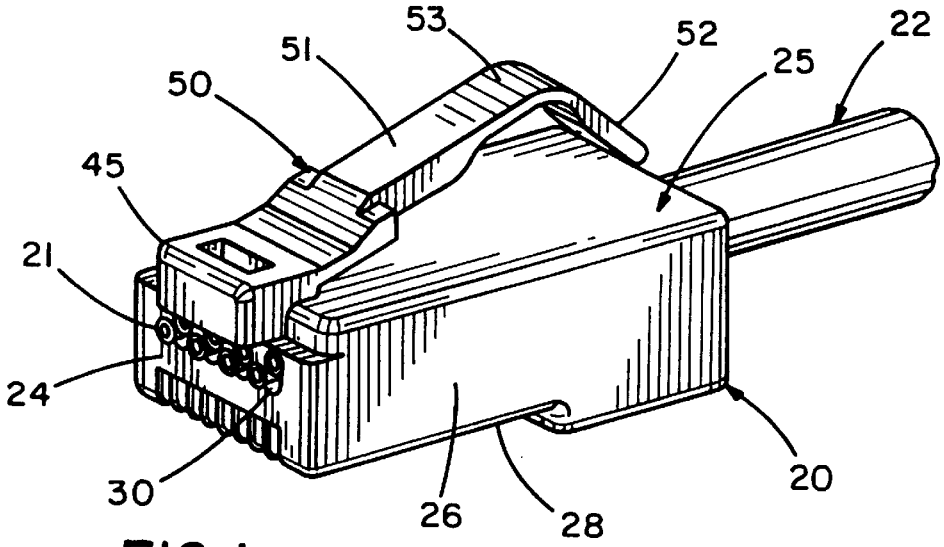
FIG. 1 is a perspective view of a modular plug connector, seen from the front, embodying the concept of the present invention.
Figure 2:
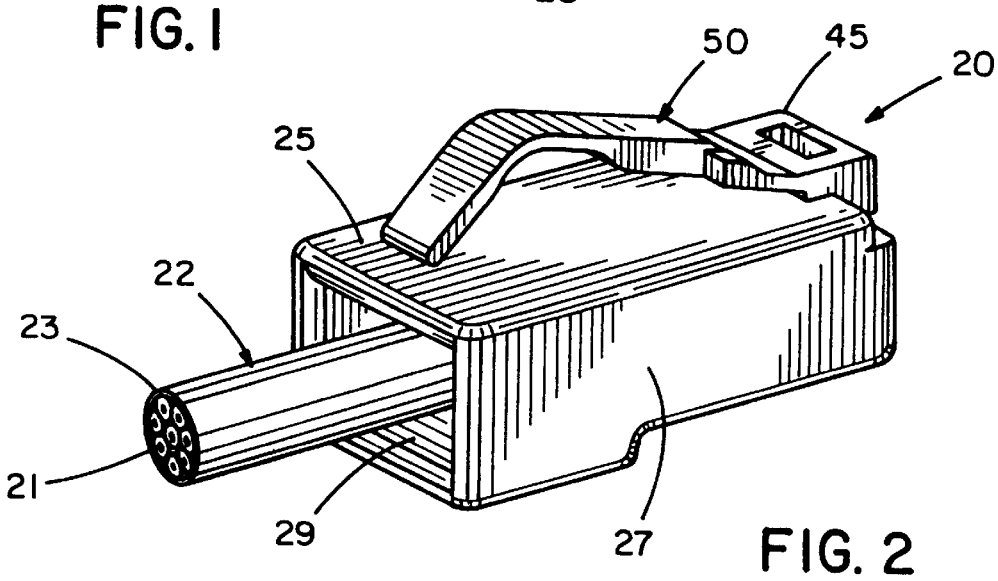
FIG. 2 is a perspective view, seen from the rear, of the connector of FIG. 1.

A modular communication plug connector embodying the concept of the present invention is designated generally by the numeral 20 in the accompanying drawings. Modular plug 20 is integrally formed of polycarbonate.

Preferably modular plug connector 20 is designed to terminate insulated conductors 21 of a twisted pair cable 22. Signal pairs of conductors 21 are twisted together along their length to reduce cross talk between conductors 21 and are enclosed in a protective sheath 23 of cable 22. Connector 20 also can be used to terminate untwisted pair cable, flat cable or any cable, the conductors of which are formed or can be formed into a planar array.

Figure 5:
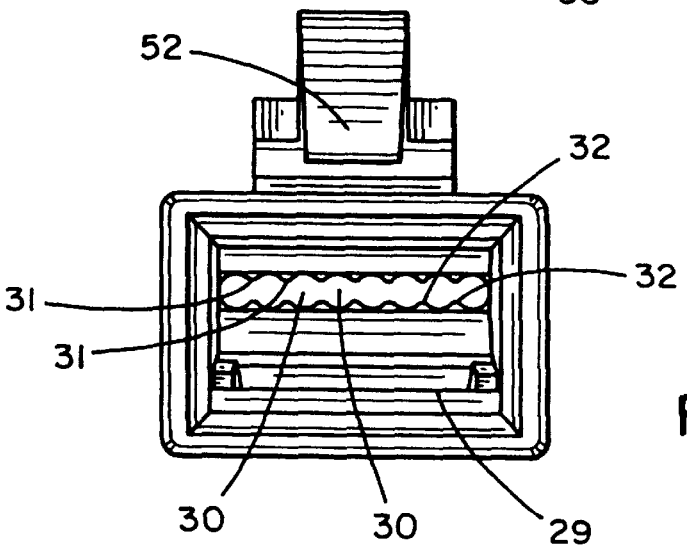
FIG. 5 is a rear view of the connector of FIG. 1.

Plug 20 includes a front face 24, a top wall 25, first and second side walls 26 and 27, and a bottom wall 28 which together define a cable receiving channel 29. Channel 29 communicates with a substantially planar array of eight conductor positioning channels 30 formed in top wall 25 and extending through front face 24, each conductor positioning channel 30 is defined on upper and lower surfaces by upper and lower ridges 31 and 32 (FIG. 5) which are spaced apart an amount to receive and accurately position individual conductors 21 there between. Channels 30, preferably allow insertion of the distal end of conductors 21 through connector 20 and past front face 24 to allow conductors 21 to be grasped and pulled outwardly to draw the twisted portion of each conductor pair as far as possible into connector 20 in order to minimize the extent of the parallel distal portion of adjacent conductors 21 and thus reduce cross talk between wire pairs to enhance connector performance.

Figure 6:
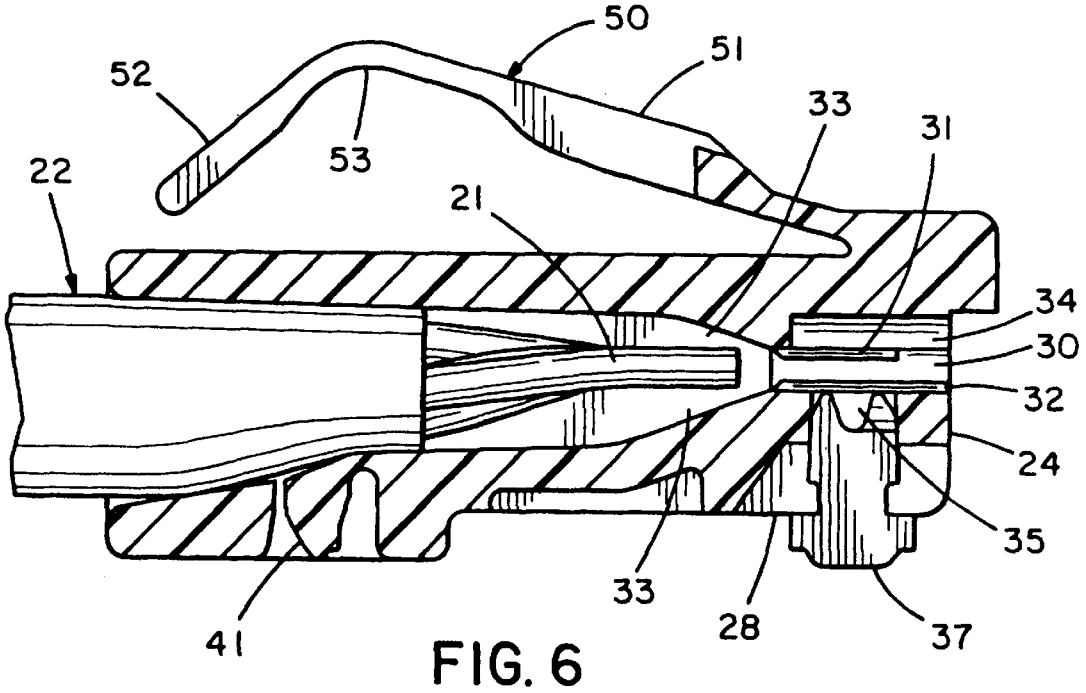
FIG. 6 is a sectional view taken along line 6—6 of FIG. 4 showing the insertion of a planar array of conductors into the connector of FIG. 1.

Cable channel 29 includes inwardly tapering walls 33 (FIG. 6) that guide individual conductors 21 into position in each respective conductor positioning channel 30.

As best seen in FIGS. 6–12, disposed parallel and adjacent to every other one of the conductor positioning channels 29 are four conductor termination slots 34 which extend parallel to channels 30 and through front face 24 of connector 20. Slots 34 merge and communicate along their length with respective alternating channels 30 such that a conductor 21 initially positioned in a respective conductor positioning channel 30 can be moved laterally of its length into a respective contiguous slot 34.

Figure 10:
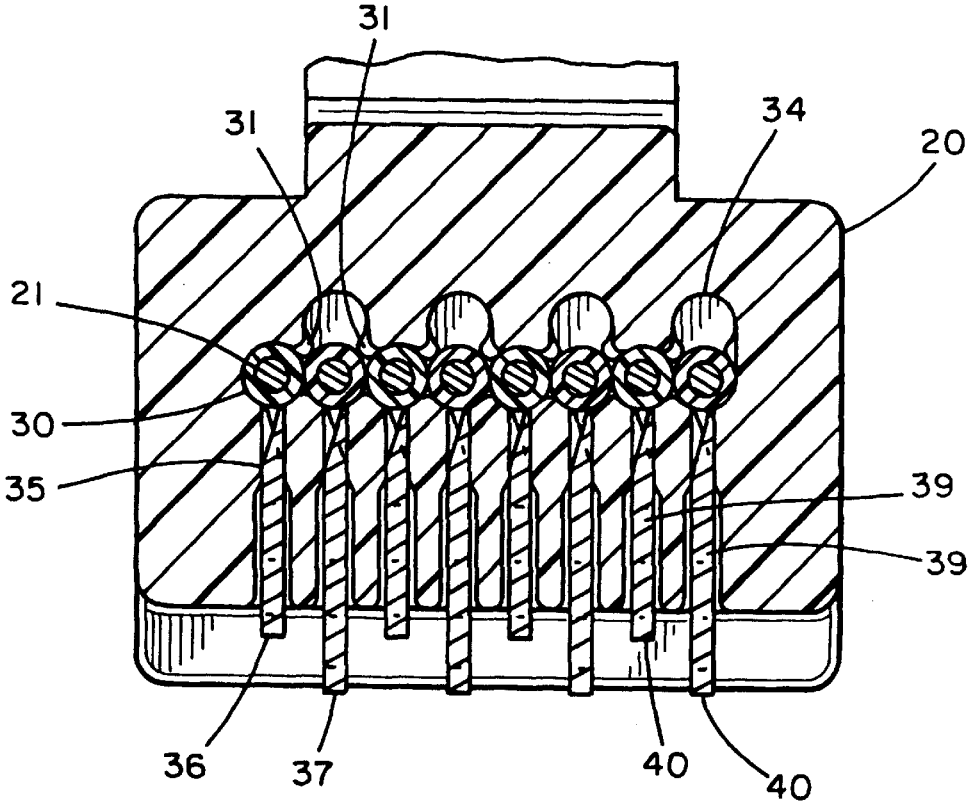
FIG. 10 is a sectional view of the connector prior to termination taken along line 10—10 of FIG. 9.
Figure 11:
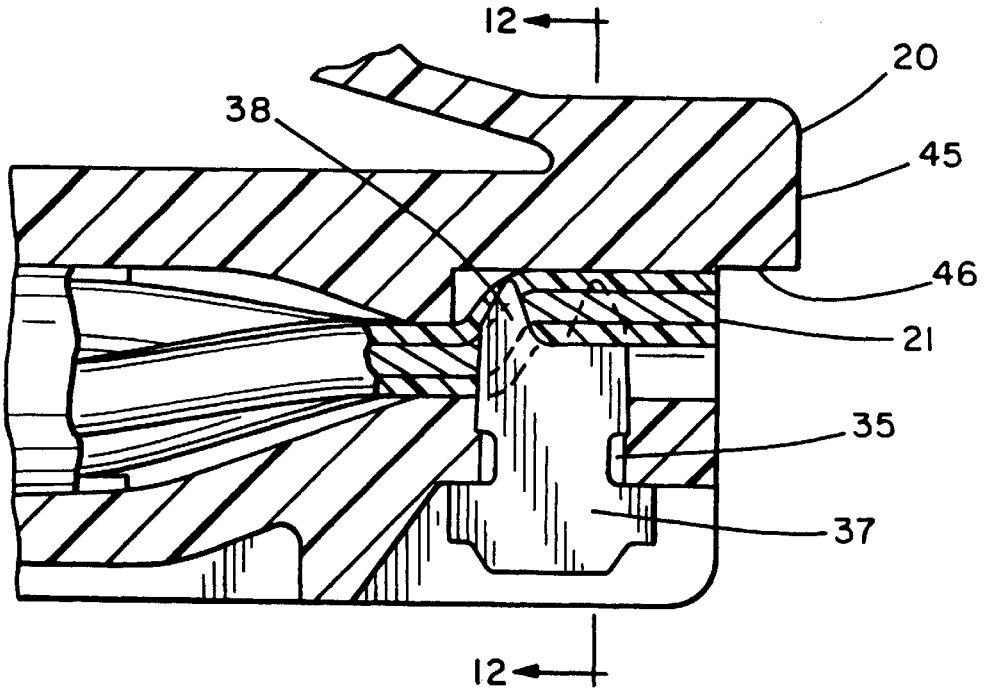
FIG. 11 is a fragmentary sectional view of a terminated connector taken along line 6—6 of FIG. 4 showing terminated conductors.
Figure 12:
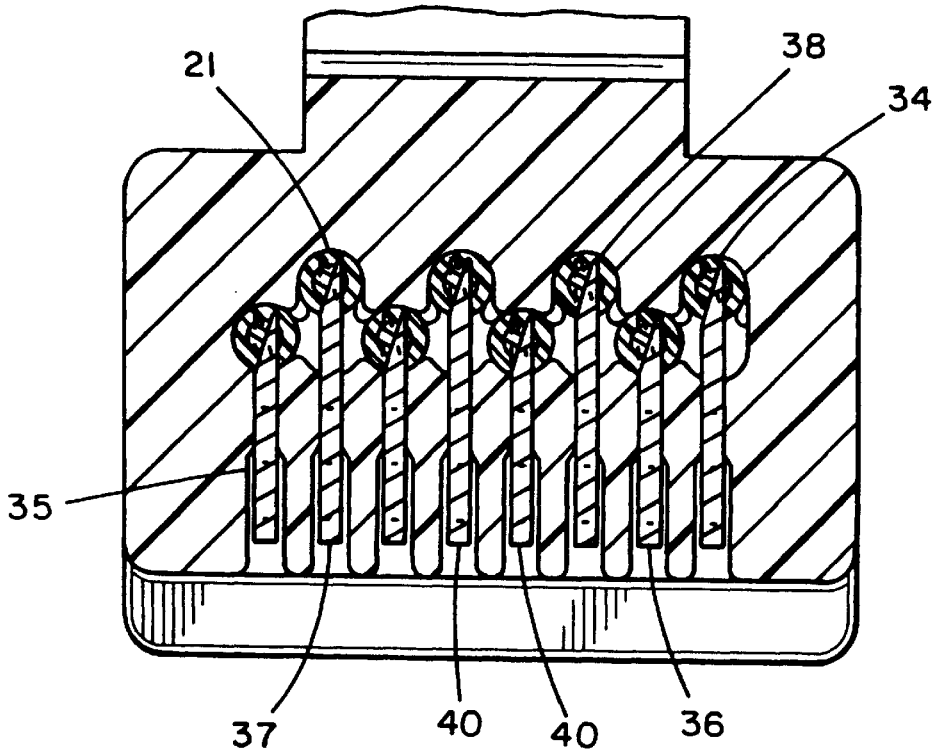
FIG. 12 is a sectional view taken along line 12—12 of FIG. 11.

Upper ridges 31, as seen in FIG. 10, project inwardly to an extent sufficient to interfere with a conductor 21 positioned in channels 30, preventing a conductor from freely entering slot 34, while being spaced apart sufficiently to allow conductor 21 to be forced into slot 34 upon termination.

A plurality of contact slots 35 are formed in bottom wall 28 of connector 20, with each contact slot 35 being aligned with and communicating one of the conductor positioning channels 30 such that planar insulation displacement contacts positioned in contact slots 35 are aligned to terminate conductors 21 positioned in conductor positioning channels 30.

Figure 9:
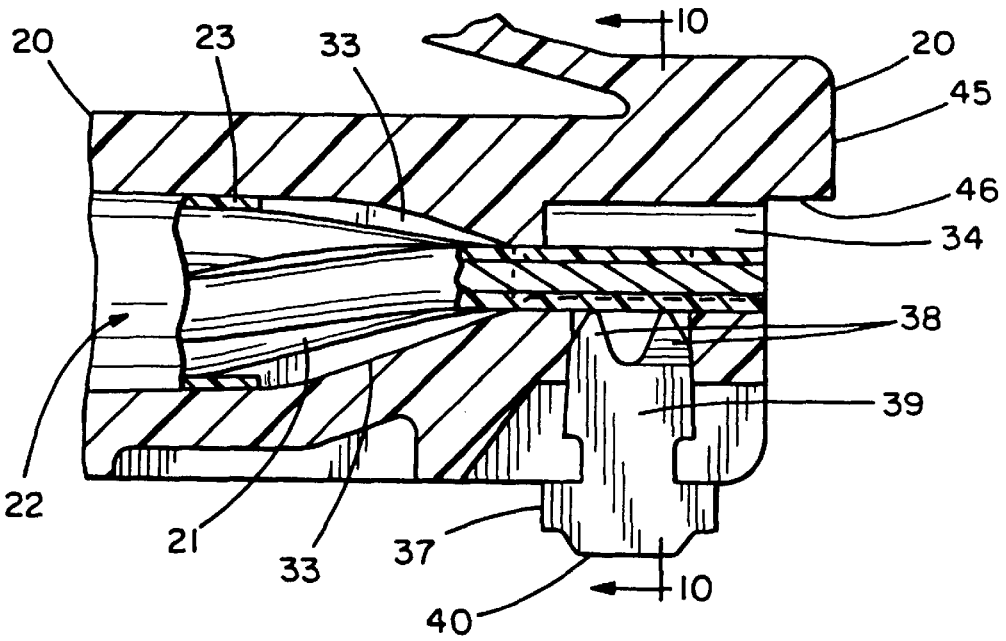
FIG. 9 is a fragmentary sectional view taken along line 6—6 of FIG. 4 showing the position of the conductors prior to termination.

As best seen in FIGS. 9 and 10, planar insulation displacement contacts 36 and translation insulation displacement contacts 37 are disposed in contact slots 35. Insulation displacement contacts 36 and 37 each include insulation piercing barbs 38, a body portion 39 and a outer contact crown 40.

As seen in FIG. 10, body portions 39 of translation contacts 37 are greater in length than body portions 39 of contacts 36. Translation contacts 37 are disposed in contact slots 35 that are aligned with conductor termination slots 34.

As seen in FIGS. 6 and 9–12, the portion of upper conductor positioning ridges 31 opposite barbs 38 of contact 37 initially holds the portion of conductor 21 position therein in alignment with barbs 38 so that barbs 38 of contact 37 pierce the insulation of conductor 21 before translating conductor 21 into conductor termination slot 34, ensuring that conductor 21 does not move out of engagement with contact 37 during termination.

As best seen in FIGS. 5–8, lower conductor positioning ridges 32 extend the length of conductor positioning channels 30 while upper conductor positioning ridges 31 only extend from the entrance of channels 30 to a point just past contact slots 35. Thus upon termination of a conductor by contacts 37 in contact slots 35, the portion of the free end of conductor 21 that extends beyond contact 37 is free to move unimpeded into contact termination slot 34 (FIG. 11) without affecting the quality of the conductive engagement between contact 37 and conductor 21, which may result if ridges 31 extended the length of channels 30 and slots 34 and the free end of conductor 21 could not move freely into slot 34.

Termination of contacts 36 and 37 into conductive engagement with conductors 21 is accomplished by forcing the eight conductors 36 and 37 inwardly into engagement with each individual conductor 21, with longer translation contacts 37 aligned with conductor termination slots 34 displacing the distal end of each conductor from its conductor positioning channel 29 into a contact slot 35 where conductor 21 is terminated. See FIGS. 11 and 12. The shorter length contacts 36 terminate conductors 21 in respective conductor positioning channels 30. The relative length of contacts 36 and 37 are chosen to result in alignment of contact crowns 40 of contacts 36 and 37 after termination of conductors 21 by contacts 36 and 37. See FIG. 12.

A conventional strain relief wedge 41 (FIG. 13) is formed in bottom wall 28 and is disposed to engage sheath 23 of cable 22.

Termination of the conductors of a twisted pair cable within connector 20 is accomplished by removing an end portion of the sheath of cable 22, untwisting and arranging the eight conductors 21 in a parallel orientation and in the correct sequence in a substantially planar array with the extent of the untwisted, parallel distal end of conductors 21 being sufficient to securely grasp the arranged array during insertion into connector 20, inserting the array of conductors 21 through conductor positioning channels 30 (FIG. 6) with the free ends of the conductors projecting past front face 24, pulling the free ends of the conductors outwardly to draw the twisted sections of each conductor pair tightly into the connector to ensure that the twisted portions of the conductors are as close as possible to contacts 36 and 37, forcing contacts 36 and 37 into conductive engagement with conductors 21 and stain relief wedge 41 into engagement with sheath 23 (FIGS. 9–13) with a modular plug termination tool (not shown), and severing the portion of conductors 21 extending from front face 24 of connector 20. The termination tool (not shown) initially engages insulation displacement contacts 37 forcing contacts 37 inwardly against conductors 21 positioned in respective conductor positioning channels 30. Continued inward movement of contacts 37 forces conductors 21 between upper ridges 31 into conductor termination slots 34, with the tool then engaging contacts 36 and 37 to force all of the contacts inwardly to terminate contacts 36 and 37 to conductors 21. An alternative termination method would sever the portion of the conductors extending from front face 24 of connector 20 after pulling the conductors tightly into connector 20 and prior to termination of contacts 36 and 37 to conductors 21.

To prevent any possibility of undesired contact with terminated conductors 21, front face 24 of connector 20 could be covered with a snap-on cap (not shown) or other means to close and seal channels 30 and slots 34 after termination of conductors 21.

Figure 3:
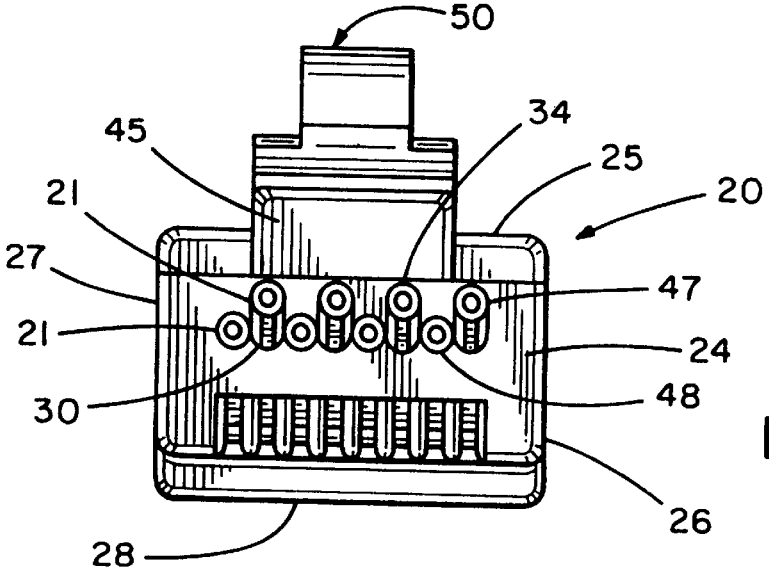
FIG. 3 is front view of the connector of FIG. 1.
Figure 4:
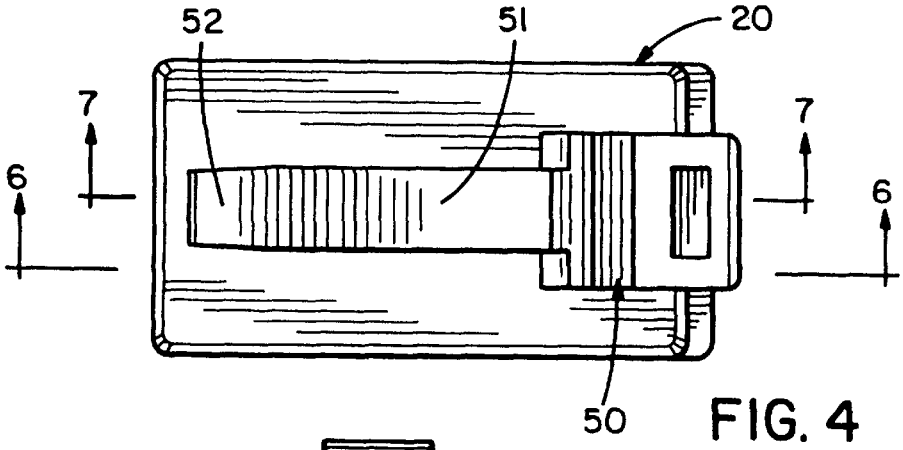
FIG. 4 is a top view of the connector of FIG. 1.
Figure 13:
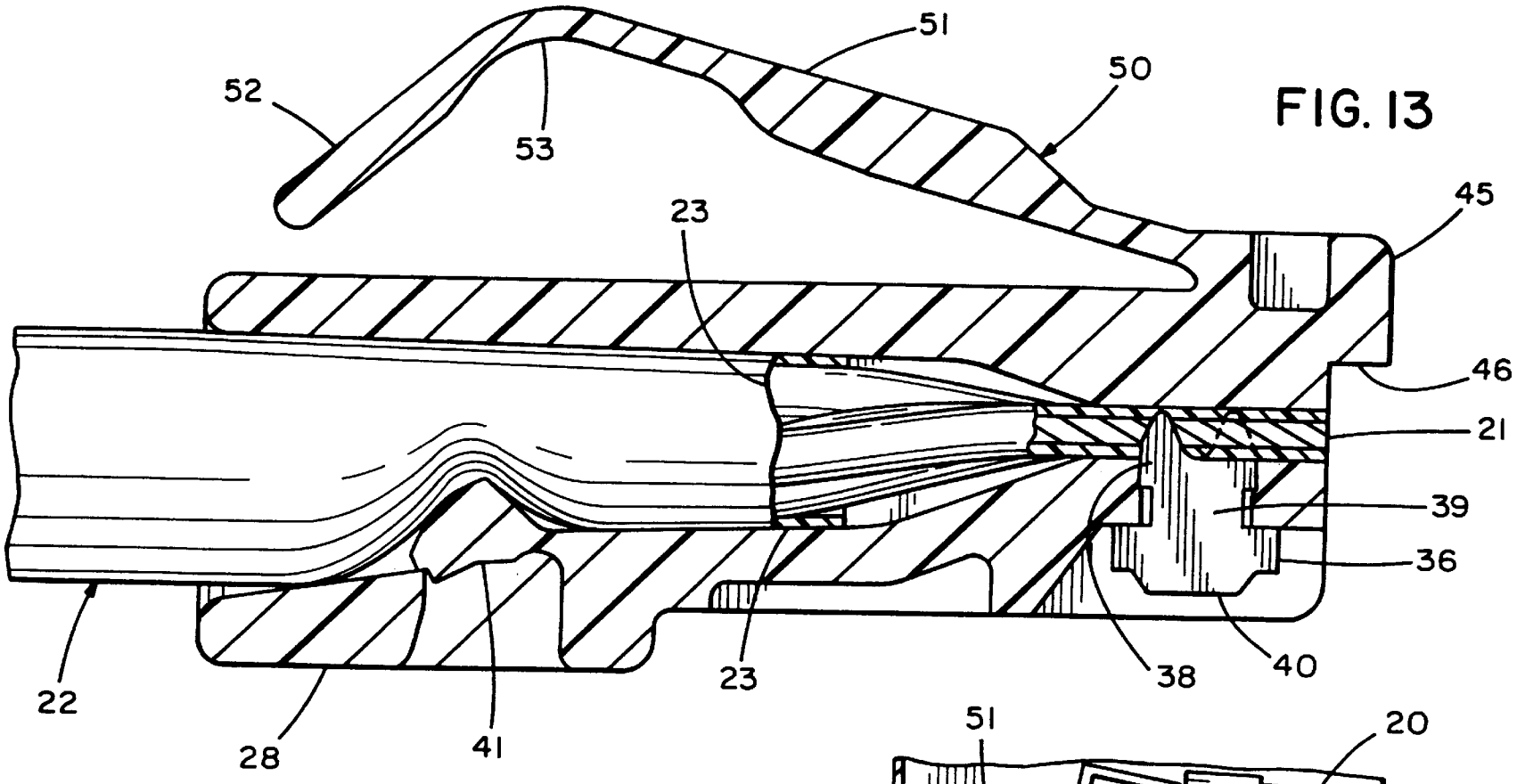
FIG. 13 is a sectional view showing the connector of FIG. 1 terminated to a cable.

As seen in FIGS. 1, 3 and 13, connector 20 includes a guide nose 45 formed on top wall 25 and projecting beyond front wall 24 which is designed to guide connector into accurate alignment with a standard jack connector. As seen in FIG. 3, Guide nose 45 is medially aligned with the width of connector 20 and is only adjacent to three of four conductor termination slots 34. Guide nose 45 includes an anvil surface 46 (FIG. 13) which supports the conductors 21 disposed in the three conductor termination slots 34 adjacent to guide nose 45 during cutoff of conductors 21. As seen in FIG. 3, conductor 21 in unsupported termination slot 47, is not supported by anvil surface 46 which, depending upon the construction of the termination tool, could prevent a clean cut off of conductor 21 in sot 47. To prevent any such possibility, connector 20 can be modified to remove this unsupported termination slot 47 and merely utilize an additional conductor positioning channel 30 aligned with an adjacent conductor positioning channel 48, thus using only three staggered conductor termination slots 34 while still achieving Category 5 performance. Alternatively, slot 47 of FIG. 3 could be formed in a partially staggered position between the fully staggered slots 34 and channels 30.

When used to terminate shielded or unshielded 100 ohm cable twisted pair Category 5 cable meeting EIA/TIA TSB-36, the final staggered disposition of the distal ends of conductors 21 provides a plug connector that has been found to reduce cross talk induced by the connector an amount sufficient to consistently exceed Category five cross talk performance as specified by the Electronics Industries Association and the Telecommunications Industry Association, "EIA/TIA" in specification SP-2840, with the plug and cable tested under TSB-67 certification test equipment for Category 5 Compliance and the plug alone tested under TSB-40 Termination Component Requirements while providing a connector that can be economically manufactured and easily terminated, without the use of a separate wire loading bar, merely by inserting a planar array of conductors into the connector and terminating the plug connector.

Although described as used in a modular plug connector, the present invention would be useful in any type of connector to reduce cross talk in a connector where it is desirable to initially position a substantially planar array of conductors in the connector for termination.

Figure 7:
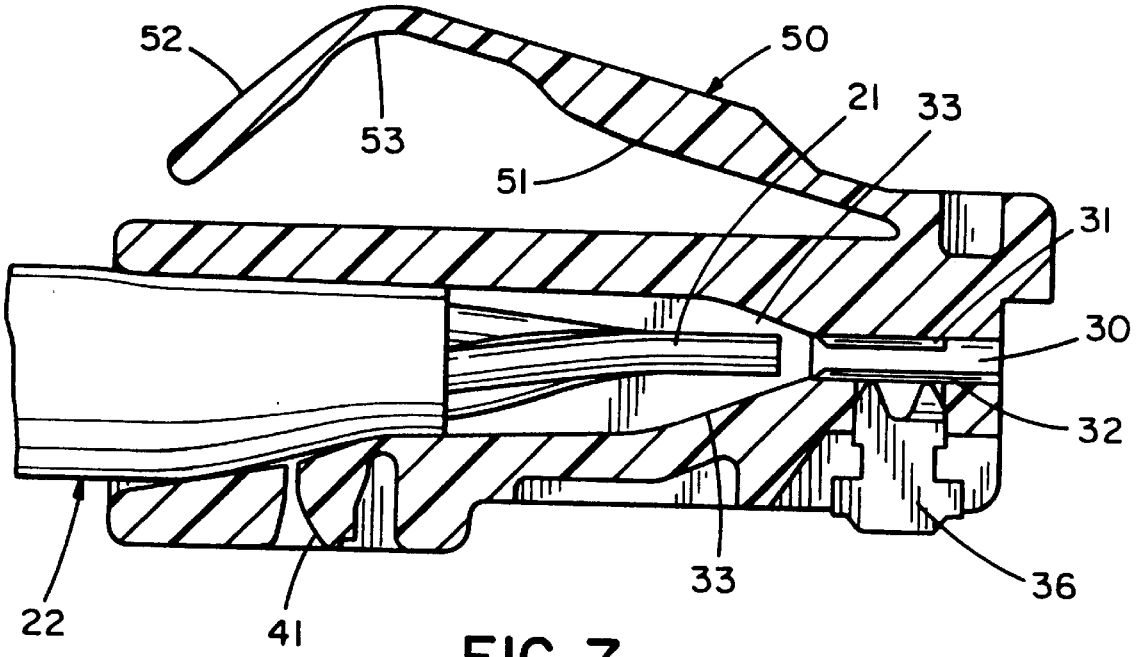
FIG. 7 is a sectional view taken along line 7—7 of FIG. 4 showing the insertion of a planar array of conductors into the connector of FIG. 1.
Figure 8:
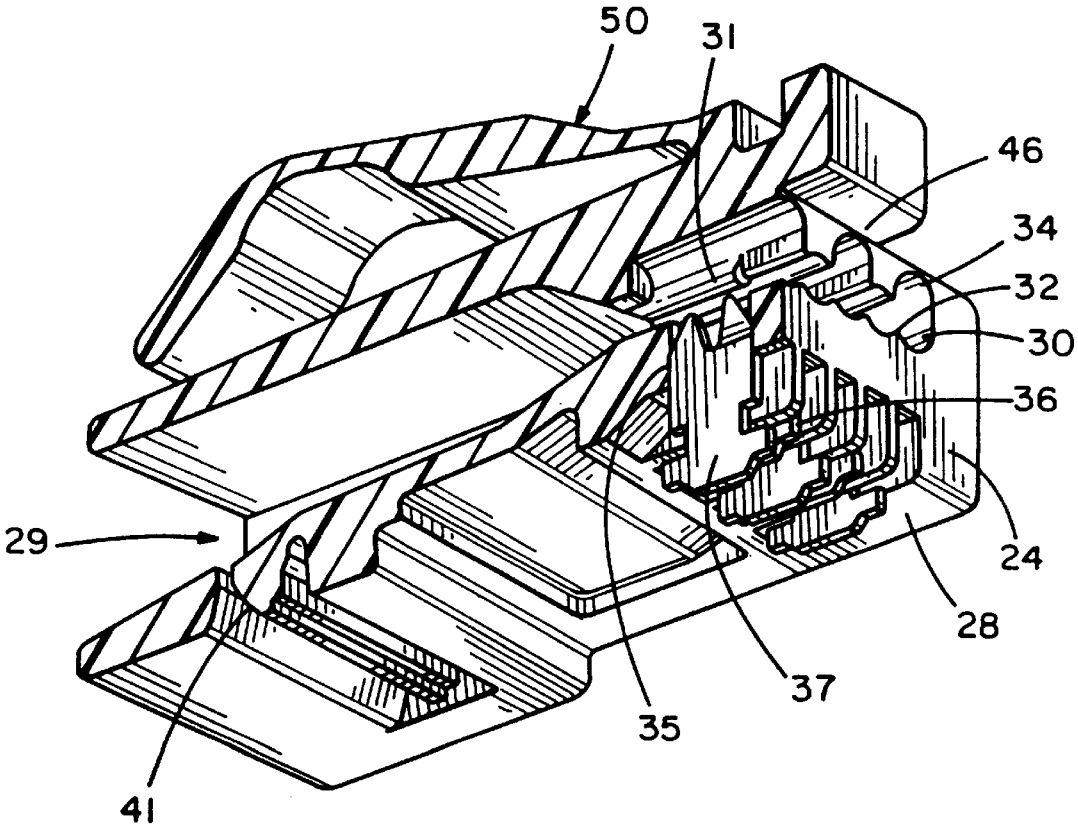
FIG. 8 is a perspective view of the connector of FIG. 1, sectioned along line 6—6 of FIG. 4.
Figure 14:
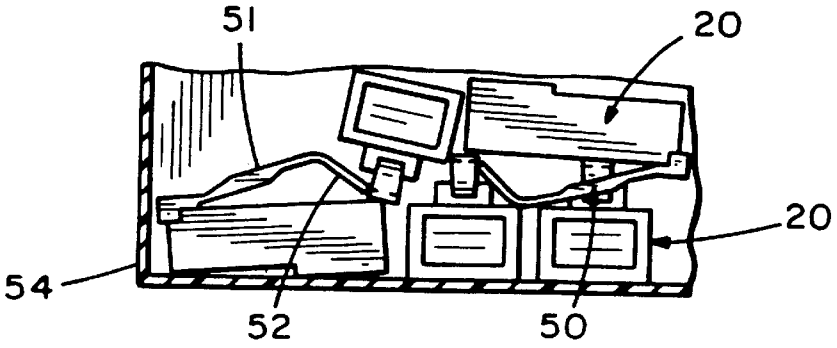
FIG. 14 is a fragmentary sectional view of a container for a plurality of connectors.

As best seen in FIGS. 1 and 7, connector 20 includes a cantilever latch arm 50 having a first portion 51 integrally formed with connector 20 which extends outwardly away from the connector 20 and a free end portion 52 joined to the first portion by a living hinge 53. Free end portion 52 extends downwardly toward top wall 25 of connector 20 terminating in close proximity to top wall 25 such that free end portion 52 is less likely to tangle with other latch arms 50 of other connectors 20 in a package of connectors 54, see FIG. 14, or snag on other surfaces when in use. Latch arm 50 prevents snagging or tangling of the latch arm while allowing free unimpeded access to latch arm 50 in use to facilitate release of connector 20 from a jack.

Figure 15:
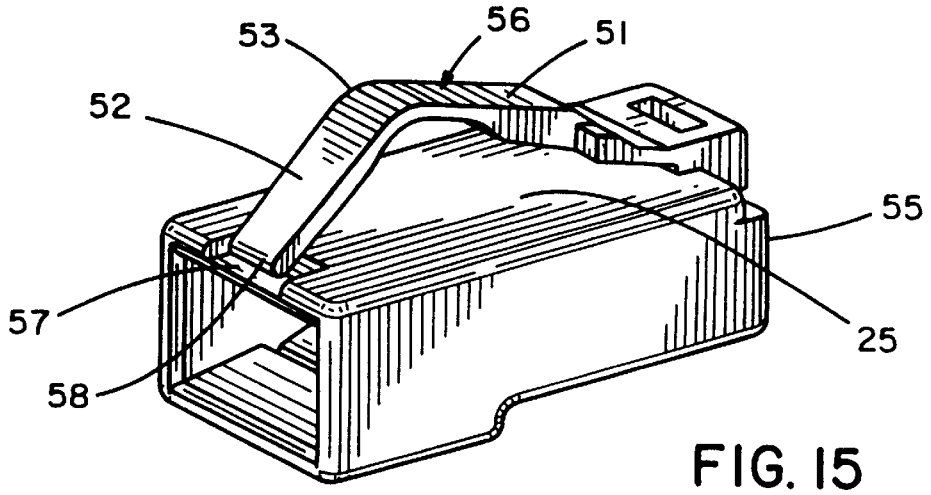
FIG. 15 is a perspective view of a modular plug connector having an enhanced tangle free latch arm embodying the concept of the present invention.
Figure 16:
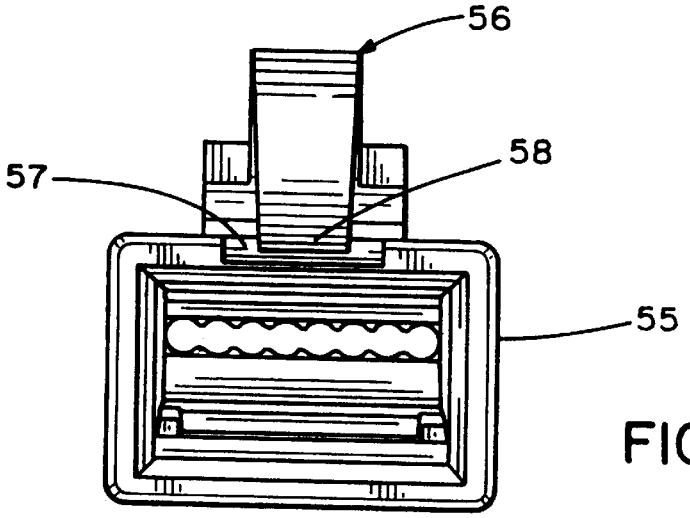
FIG. 16 is a rear view of the connector of FIG. 15.
Figure 17:
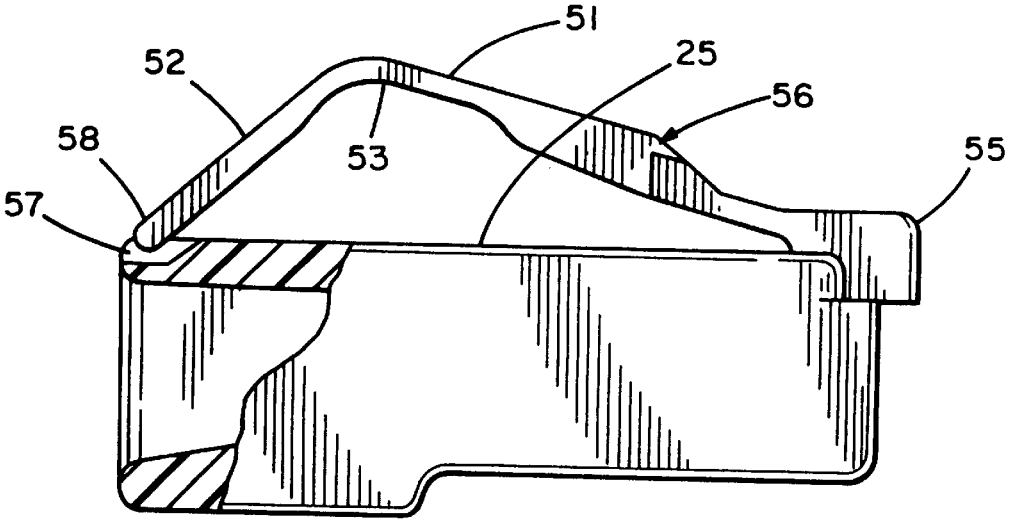
FIG. 17 is a side view of the connector of FIG. 15.

Another embodiment is depicted in FIGS. 15–17, showing a connector 55 having a tangle free latching arm 56 with common features as described and numbered above is depicted in FIGS. 15–17. Connector 55 includes a inset or depression 57 formed in top wall 25 of connector 55, which is disposed to receive the distal tip 58 of free end portion 52 such that tip 58 extends below the surface of top wall 25 and does not leave any gap between tip 58 and top wall 25 to prevent any possibility of another object snagging there between.

While the particular preferred embodiments of the present invention has been shown and described, it will be obvious to those skilled in the art that changes and modifications may be made without departing from the teachings of the invention.

We claim:

1. A connector having an integrally formed cantilever latch arm projecting outwardly from the connector, comprising:

an unshrouded projecting free end portion formed on the cantilever latch arm; and a distal end of the free end portion;

the unshrouded free end portion projecting inwardly toward a top wall of the connector to dispose the distal end in sufficient proximity with the top wall such that the latch arm is less likely to tangle or snag with other objects, and the free end portion is disposed substantially above the extent of the top wall such that free unimpeded access to the free end portion facilitates release of the connector during which the distal end longitudinally extends unimpeded in a direction opposite a front face.

2. A connector as set forth in claim 1, including a depression formed in the connector top wall disposed to receive the distal end of the unshrouded free end such that the distal end extends below the top wall of the connector.

3. A connector having an integrally formed cantilever latch arm projecting outwardly from the connector, comprising:

an unshrouded inwardly projecting free end portion formed on the cantilever latch arm;

a distal end of the free end portion; and a top wall of the connector having a substantially flat planar configuration;

wherein the unshrouded free end portion projects inwardly toward the top wall of the connector to a point in sufficient proximity with the surface such that the latch arm is less likely to tangle or snag with other objects, and the free end portion is disposed substantially above the top wall of the connector such that free unimpeded access to the free end portion facilitates release of the connector during which the distal end longitudinally extends unimpeded in a direction opposite a front face upon flexure of the latch arm.

4. A connector as set forth in claim 3, including a depression formed in the top wall of the connector disposed to receive the distal end of the unshrouded free end such that the distal end below the top wall of the connector.

5. A connector having an integrally formed cantilever latch arm projecting outwardly away from the connector, comprising:

an unshrouded inwardly projecting free end portion formed on the latch arm with the unshrouded free end portion having a distal end;

the distal end of the inwardly projecting unshrouded portion disposed above and in sufficient proximity with a flat planar top wall of the connector such that the unshrouded free end portion may be freely contacted when the connector is installed and the latch arm is less likely to tangle or snag with other objects whereby the distal end longitudinally extends unimpeded in a direction opposite a front face upon flexure of the latch arm.

6. A connector as set forth in claim 5, including a depression formed in the connector top wall disposed to receive the distal end of the unshrouded free end such that the distal end extends below the top wall of the connector.

7. A modular telephone plug connector having an integrally formed cantilever latch arm projecting outwardly from the connector, comprising:

an unshrouded inwardly projecting free end portion formed on the cantilever latch arm; and a distal end of the unshrouded free end portion;

the unshrouded free end portion projecting inwardly toward a top wall of the connector to dispose the distal end in sufficient proximity to the top wall such that the unshrouded latch arm is less likely to tangle or snag with other objects, and the unshrouded free end portion is disposed above the extent of the top wall such that free unimpeded access to the unshrouded free end portion facilitates release of the connector whereby the free end portion longitudinally extends unimpeded in a direction opposite a front face upon flexure of the latch arm.

* * * * *